US005526610A

United States Patent [19]

Delamare

[11] Patent Number: 5,526,610

[45] Date of Patent: Jun. 18, 1996

[54] INFLATABLE VAULT

[75] Inventor: Guy Delamare, Le Pecq, France

[73] Assignee: Société Civile Spironef, Paris, France

[21] Appl. No.: 244,507

[22] PCT Filed: Nov. 30, 1992

[86] PCT No.: PCT/FR92/01113

§ 371 Date: Jun. 16, 1994

§ 102(e) Date: Jun. 16, 1994

[87] PCT Pub. No.: WO93/11330

PCT Pub. Date: Jun. 10, 1993

[30] Foreign Application Priority Data

Nov. 29, 1991 [FR] France ..... 91 14842

[51] Int. Cl.[6] ..... E04B 1/34

[52] U.S. Cl. ..... 52/2.24; 52/2.18; 52/582.1

[58] Field of Search ..... 52/2.11, 2.18, 52/2.19, 2.22, 2.23, 2.24, 582.1, 583.1, 587.1; 403/291, 392, 393, 397

[56] References Cited

FOREIGN PATENT DOCUMENTS 0065240 11/1982 European Pat. Off. .

2062116 5/1971 France .

2621944 4/1989 France .

2223158 11/1972 Germany .

2903169 7/1980 Germany .

*Primary Examiner*—Kien T. Nguyen

*Attorney, Agent, or Firm*—Wenderoth, Lind & Ponack

[57] ABSTRACT

A multi-lobed, double-wall inflatable vault includes a plurality of distinct, inflatable hollow beams. Each beam is formed by a single continuous envelope and has four zones including two lateral zones defining webs of the beam and upper and lower zones defining flanges of the beams. The beams are arranged side by side contiguously. Respective confronting webs of two adjacent beams are held opposite each other by respective continuous longitudinal flaps that can be joined by mechanical linking structure. Each flap has a T-shaped transverse cross-sectional configuration including two lateral flanges fastened to the envelope of the respective beam and a central tongue to be linked by the linking structure to the tongue of the flap of the adjacent beam.

15 Claims, 8 Drawing Sheets

INFLATABLE VAULT

BACKGROUND OF THE INVENTION

The subject of the present invention is a multi-lobed, double-wall inflatable vault, only the volume of air included between the two walls of which is pressurized, thus leaving the space which the vault covers at ambient pressure.

Generally, such an inflatable vault comprises a plurality of longitudinal beams arranged side by side, means of sliding at least one longitudinal end of each of the beams along at least one deployment or folding path and means for supplying the beams with inflation fluid.

This type of vault is designed in order, inter alia, to permit its deployment by means of simple inflation, as well as its retraction by deflation, which makes it possible, as desired, to cover a space for the purpose of protecting it from bad weather and for uncovering it in fine weather.

Such a vault may be used for temporarily covering large-size installations, such as stadia with stands for spectators. Such a vault represents an enormous surface area of fabric, weighing from 50 to 100 tonnes, which is impossible to produce in a factory, to transport and to install as a single completely finished assembly. However, if the vault is produced as several elements, it is advisable, on the one hand, for such elements to be totally completed, tested in the factory, particularly to check their leaktightness, and, on the other hand, for the assembly of such elements together to be easy, rapid and to require no costly site equipment.

Vaults of this type are already known, in which deployment and retraction can be produced by means of simple inflation and deflation, in which only the space between the two walls is pressurized and which are described, particularly, in patents FR-A-2,166,397 and FR-A-2,326,544.

Patent FR-A-2,166,397 relates to an inflatable structure including a succession of inflatable box structures which bear on one another when they are inflated and which are placed between two sheets to which they are fastened, such sheets being stretched by the box structures on inflation of the structure. Given the design of this structure, it cannot be applied to large-size constructions which is one of the objectives which the present invention proposes to achieve.

Patent FR-A-2,326,544 relates to an inflatable flexible structure consisting of a nave with at least two walls, which can be deployed and folded or retracted, composed of a series of contiguous chambers which can be flattened and pressurized, the dividing walls of which space apart outer and inner, and, optionally median, walls of the nave. The multiple elements making up the vault are thus simple elementary panels of leaktight fabric which must be assembled on site in order to produce continuous links which are both strong and leaktight over great lengths. This requires very precise manufacturing tolerances and considerable involved assembly operations on site, which does not guarantee the total reliability of the product obtained.

An inflatable vault is also known from patent FR-A-2,621,944, in which each beam includes two opposite panels forming flanges and each constituting one of the lobes of inner or outer wall of the vault and two lateral panels forming webs of the beam.

Equivalent panels of adjacent beams are connected together with the aid of discontinuous mechanical linking means comprising, on the one hand, a series of flaps extending the panels of each beam along at least one of their longitudinal edges and, on the other hand, a plurality of profiled sections slipped one behind the other, simultaneously from one end to the other of each of the flaps to be joined.

Such linking means pose problems owing to the fact that each beam is composed of at least two independent panels, the corresponding flaps of which must be inserted in the profiled sections at the same time as the flaps of the panels of the adjacent beam, and this has to be done over the entire length of the beams.

SUMMARY OF THE INVENTION

In order to remedy these drawbacks, the object of the present invention is to provide an inflatable vault in which the assembly of inflatable hollow beams thereof is facilitated.

To this end, the subject of the present invention is a multi-lobed, double-wall inflatable vault, which can be deployed and retracted confining between its walls a layer of air under pressure and composed of a plurality of distinct, inflatable hollow beams arranged side by side. Each beam includes four zones, i.e. two lateral zones of which form webs and two zones, respectively lower and upper zones, which form flanges of the beam. Each beam is formed by a single continuous envelope ensuring the continuity of the leaktightness of the volume which it confines. Equivalent webs of each two contiguous beams are held opposite each other by continuous longitudinal flaps are fastened on the envelopes of each of such beams between the webs and the flanges thereof. Mechanical means links the equivalent flaps of the contiguous two beams.

According to further characteristics of the invention:

- each continuous flap is formed by a T-shaped profiled section, two flanges of which are fastened on the envelope of each beam and a central tongue of which is intended to receive the mechanical linking means,
- the profiled section is formed by the folding of at least one strip of coated fabric,
- the mechanical linking means comprise:
  - eyelet holes which are uniformly spaced and arranged opposite one another on the tongues of two equivalent flaps of two contiguous beams,
  - continuous filler strips trapped along the free edge of the corresponding tongue,
  - at least one continuous link slipped successively from top to bottom and from bottom to top in the pairs of eyelet holes arranged opposite one another of the tongues of two equivalent flaps,
  - the mechanical linking means are formed by slide closures each comprising two half-parts attaching to each other or detaching from each other on passage of a slider, each half-part being fastened on the tongue of one of the two equivalent flaps of two contiguous beams,
  - each tongue of the flaps is formed from two parallel lips between which is fastened a band supporting one of the two half-parts of the corresponding slide closure,
  - the webs and the flanges forming the continuous envelope of each beam are formed by intersecting surfaces, the flaps being fastened along and on either side of the intersections of such surfaces,
  - the webs and the flanges forming the envelope of each beam are formed by mutually tangential surfaces, the flaps being fastened along tangent lines of such surfaces, the flaps located on one and the same side of each beam are continuous and form a loop at each end of the beam.

According to further characteristics of the invention:

the inflatable vault comprises movable bearing fittings, arranged between the ends of two contiguous beams and connected to the flaps of such two contiguous beams, at the level of the end loops of such flaps, by fastening means. The bearing fittings interact with a fixed base equipped with guide means, the profile of which determines a deployment and folding path of each of such beams, the fastening means are formed by bolted small bars gripping the tongue of two contiguous flaps.

BRIEF DESCRIPTION OF THE DRAWINGS

The present invention will be better understood from the following detailed description, given by way of example with reference to the appended drawings, in which.

DETAILED DESCRIPTION OF THE INVENTION

Figure 1:
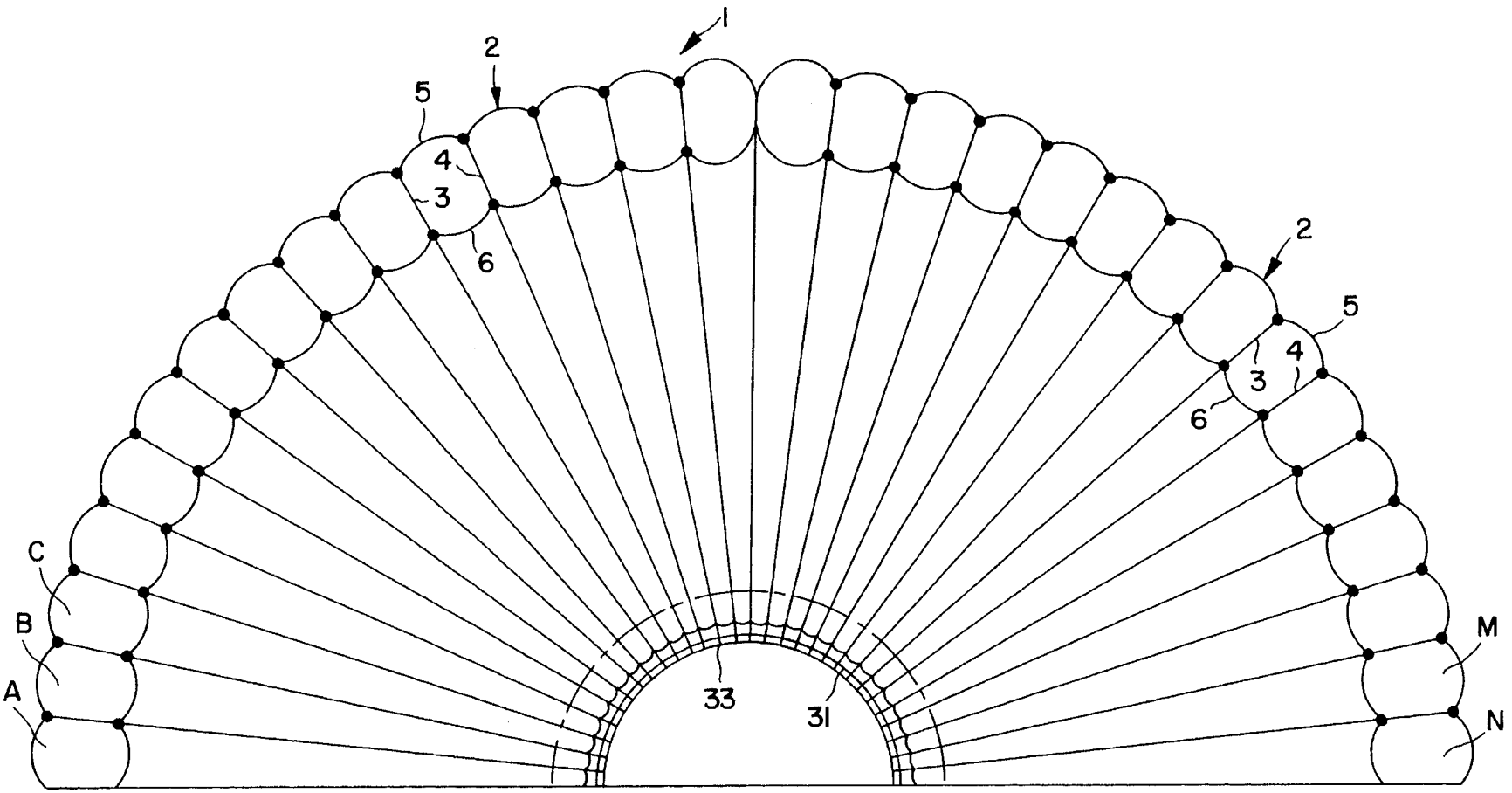
FIG. 1 is a diagrammatic overall view of a vault according to the invention, in a section according to a plane parallel to the direction of its deployment.

In FIG. 1, a multi-lobed, double-wall inflatable vault, which can be deployed and retracted, has been shown diagrammatically, denoted overall by the reference 1.

This vault 1 confines, between its walls, a volume of air under pressure and is composed of a plurality of distinct and leaktight inflatable hollow beams, A, B, C . . . M, N which are arranged side by side.

Each beam A, B, C, . . . consists of a continuous envelope 2 ensuring continuity of the leaktightness of the volume which it confines and is composed of four zones, two lateral zones of which form webs 3 and 4 and two zones, respectively an upper zone and a lower zone, of which form the flanges 5 and 6 of each beam.

Figure 2:
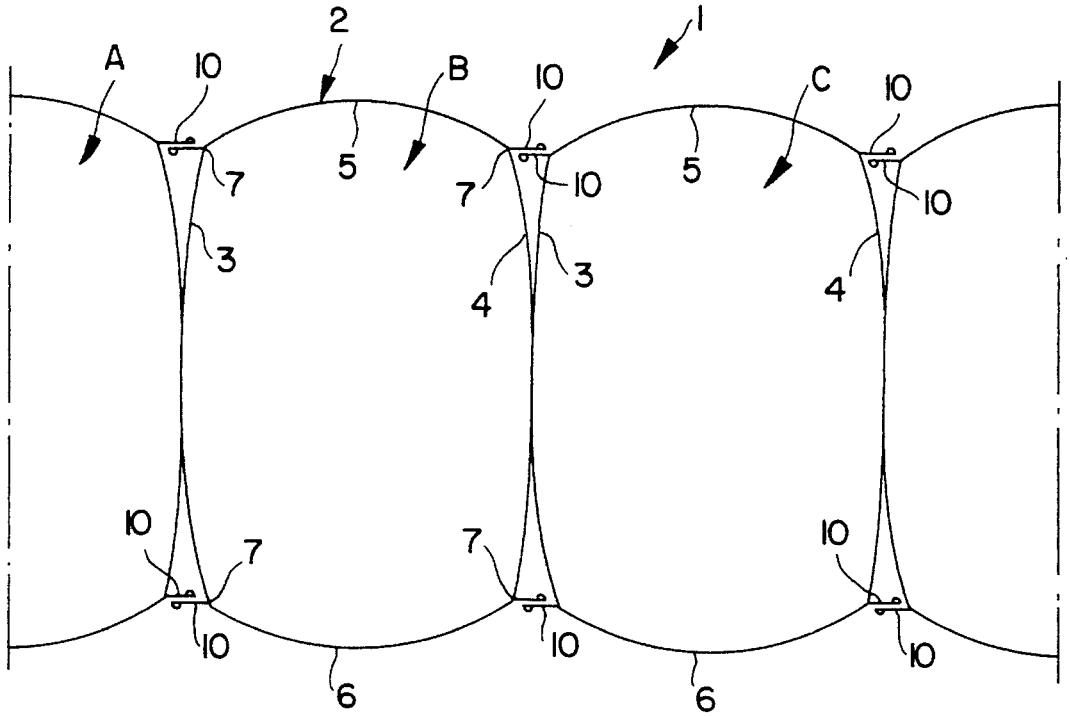
FIG. 2 is a diagrammatic view in section of a vault portion according to a first embodiment of the invention.

According to a first embodiment shown in FIG. 2, the webs 3 and 4 and the flanges 5 and 6 forming the continuous envelope 2 of each beam A, B, C, . . . are formed by surfaces which intersect at four intersections 7.

Figure 3:
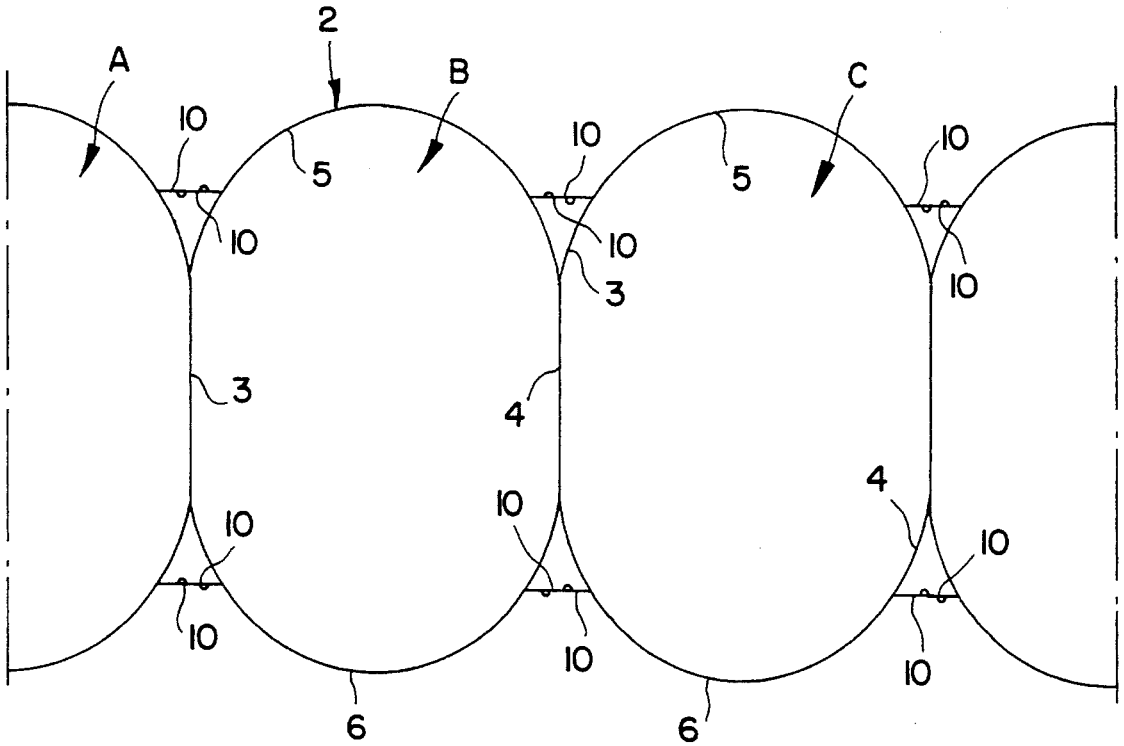
FIG. 3 is a diagrammatic view in section of a vault portion according to a second embodiment of the invention.

According to a second embodiment shown in FIG. 3, the webs 3 and 4 and the flanges 5 and 6 forming the continuous envelope 2 of each beam A, B, C, . . . are formed by mutually tangential surfaces.

The equivalent webs 3 and 4 of two contiguous beams A, B, C, . . . are held opposite each other by continuous and longitudinal flaps 10 fastened on the envelope 2 of each beam and including mechanical means or structure for linking with the equivalent flap 10 of the contiguous beam.

In the case in which the webs 3 and 4 and the flanges 5 and 6 of each beam A, B, C, . . . are intersecting, a flap 10 is fastened along each intersection 7 (FIG. 2).

In the case in which the webs 3 and 4 and the flanges 5 and 6 of each beam A, B, C, . . . are tangential, a flap 10 is fastened along the tangent lines of the webs 3 and 4 and of the flanges 5 and 6 (FIG. 3).

As shown in FIGS. 4 to 7, each flap 10 which is continuous, is formed by a T-shaped profiled section, i.e. transverse cross-sectional configuration, two flanges 11 and 12 of which are fastened on the envelope 2 of each beam A, B, C, . . . and a central tongue 13 of which is intended to receive the mechanical linking means.

The profiled section is formed, for example, by the folding of at least one strip of coated fabric.

Figure 4:
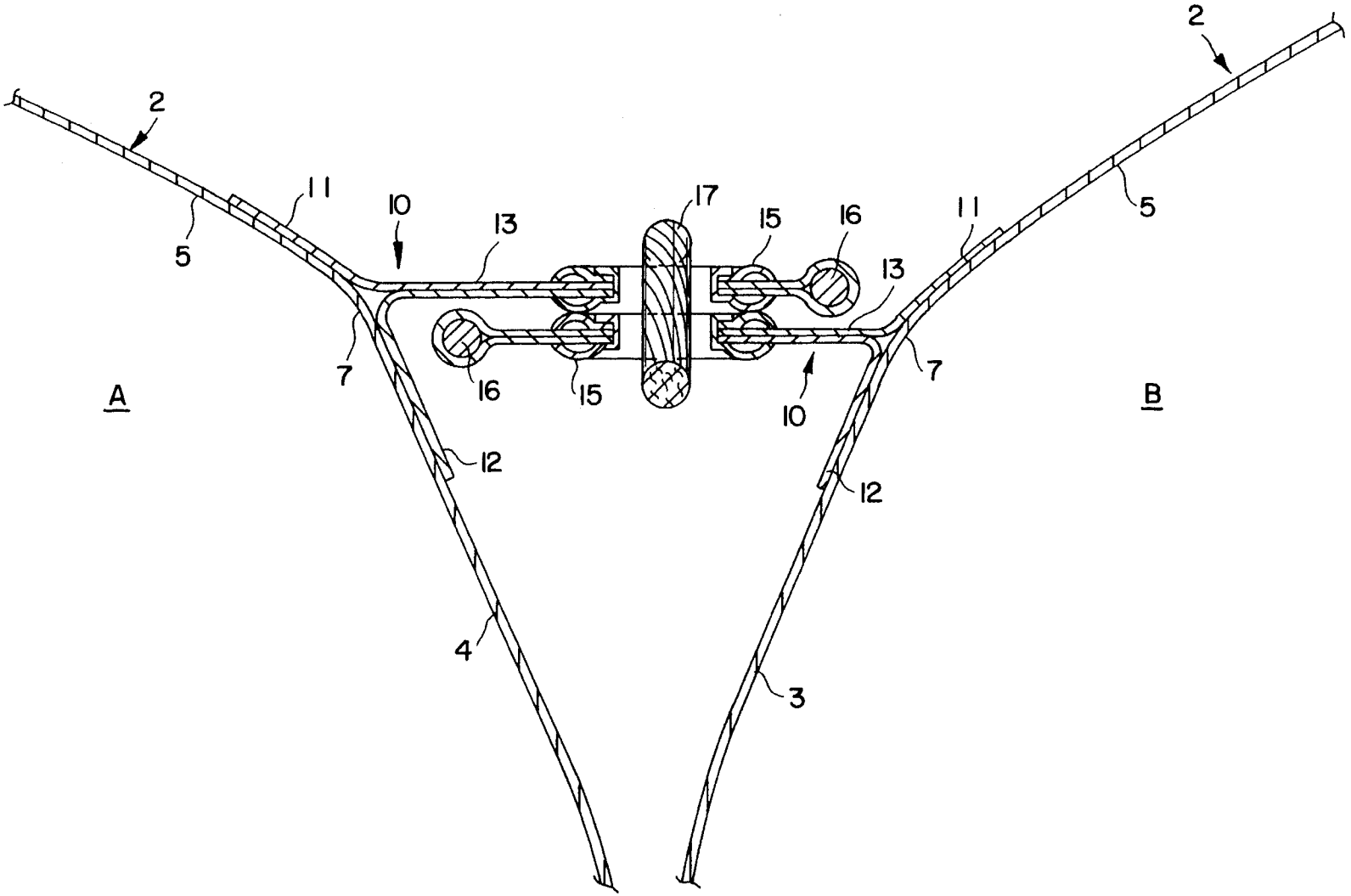
FIG. 4 is a view in section of a first embodiment of mechanical means for linking two contiguous beams.
Figure 5:
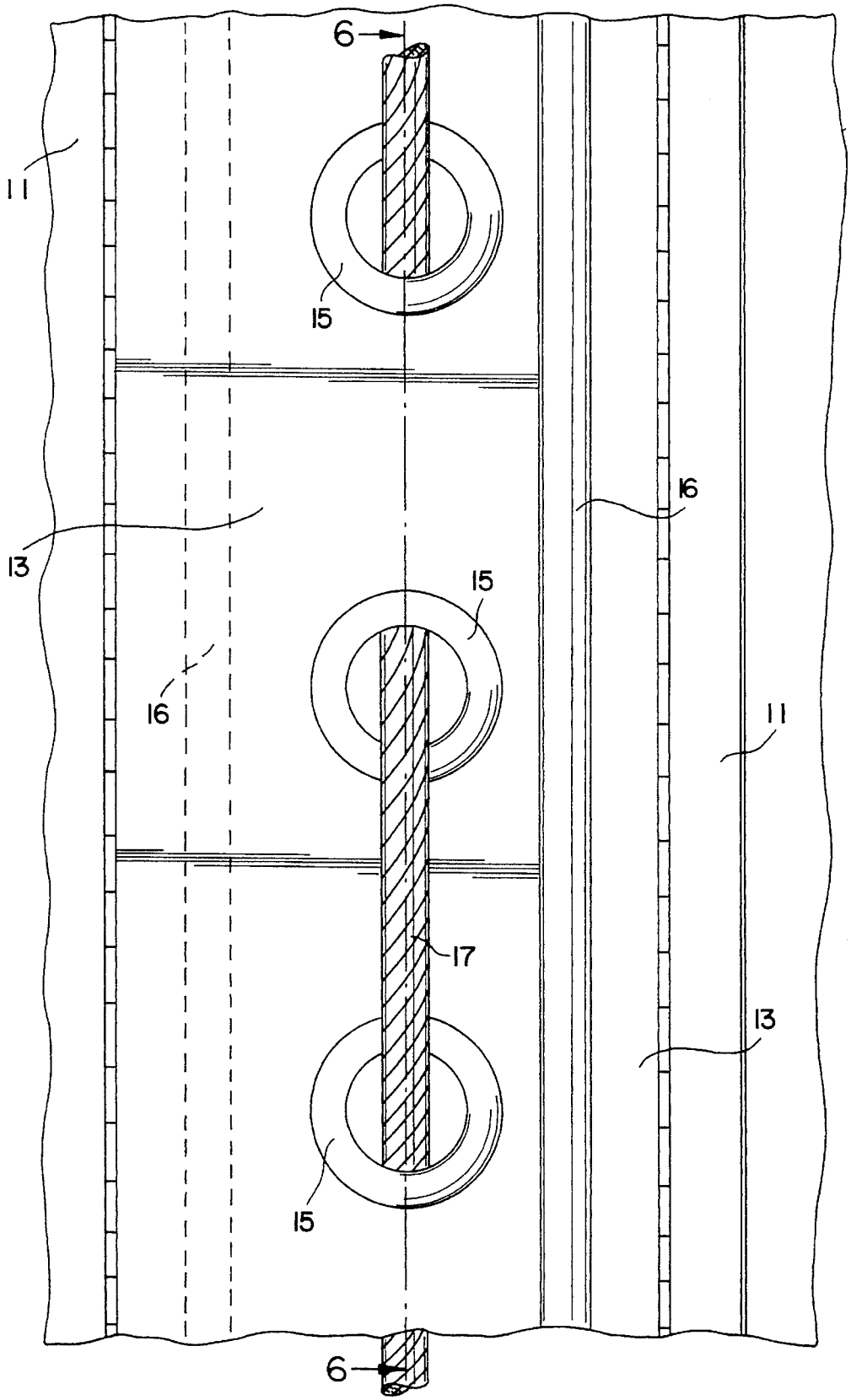
FIG. 5 is a plan view of the mechanical linking means of FIG. 4.
Figure 6:
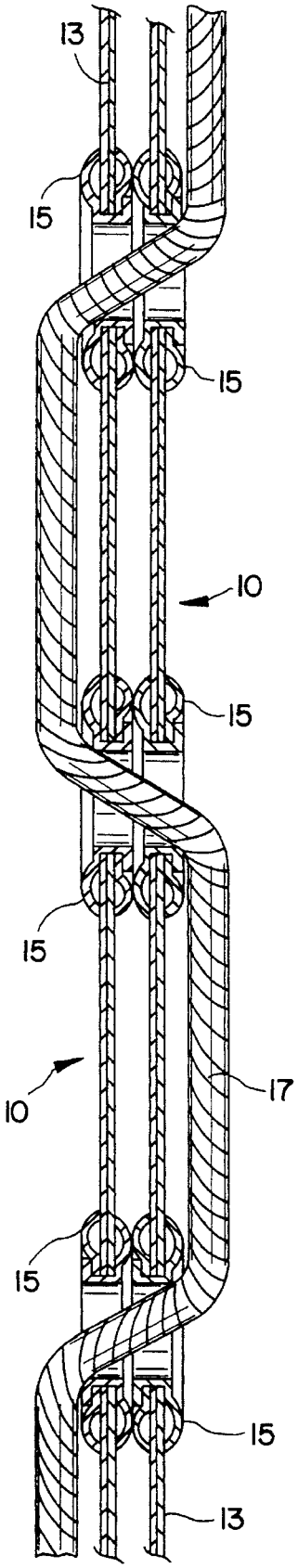
FIG. 6 is a view in section along line 6—6 in FIG. 5.

By referring, now, to FIGS. 4 to 6, a description will be given of a first embodiment of the mechanical means or structure for linking two contiguous beams.

These mechanical linking means comprise, on the one hand, crimped, metallic eyelet holes 15 which are uniformly spaced and arranged opposite one another on the tongues 13 of the equivalent flaps 10 of the contiguous beams A, B, C, . . . , and, on the other hand, continuous filler strips 16 trapped in a hem formed by the free edge of each tongue 13.

The link of two contiguous flaps 10 and, consequently, of the beams together is produced by a continuous link 17 such as, for example, a cable or a lace slipped successively from top to bottom and from bottom to top in the pairs of eyelet holes 15 arranged opposite one another of the tongues 13 of two equivalent flaps 10.

Figure 7:
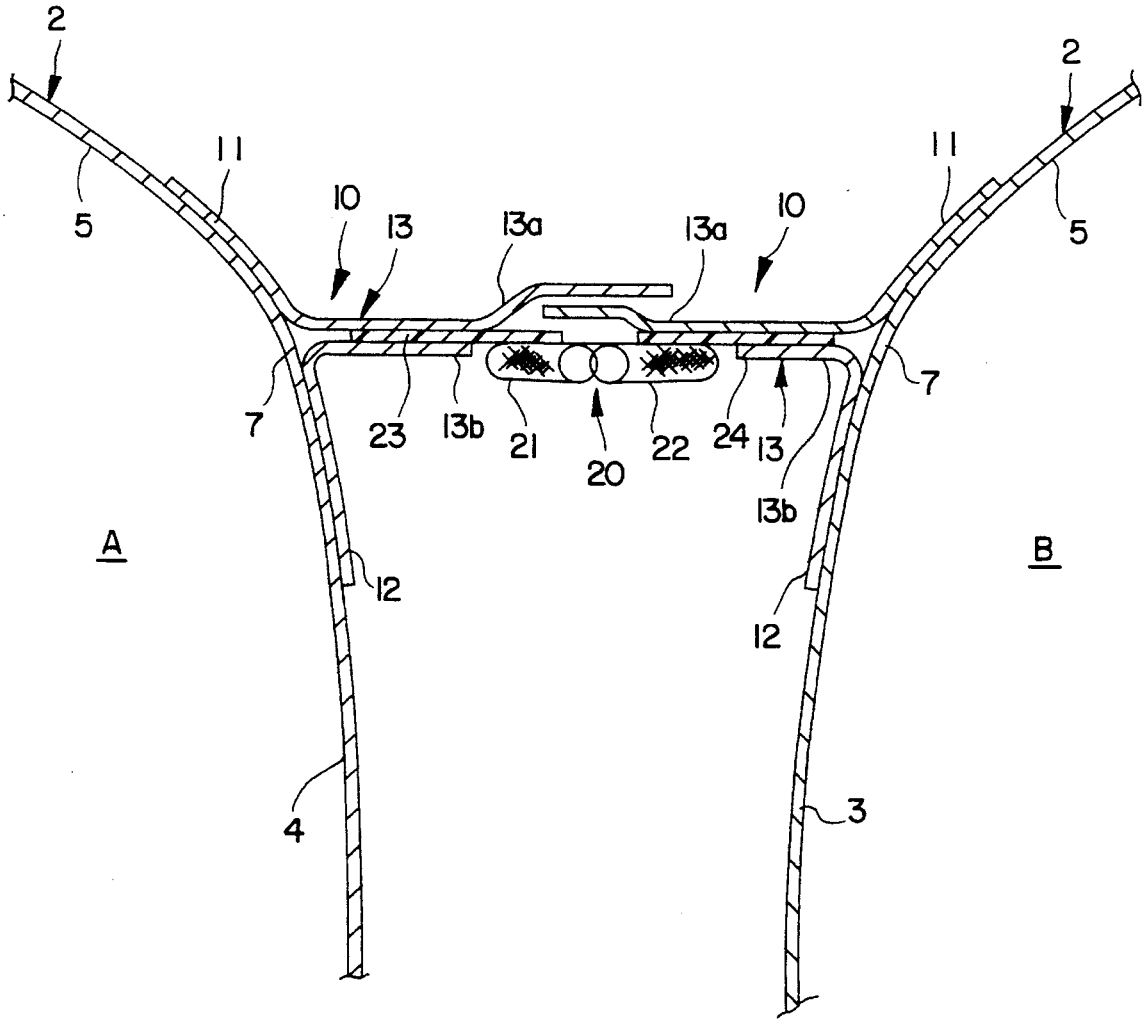
FIG. 7 is a view in section of a second embodiment of mechanical means for linking two contiguous beams.

By referring, now, to FIG. 7, a description will be given of a second embodiment of the mechanical means for linking two contiguous beams.

In this case, the mechanical means for linking two contiguous flaps 10 are formed by a slide closure 20.

Each slide closure 20 is composed of two half-parts 21 and 22 attaching to each other or detaching from each other on passage of a slider which is not shown.

Each half-part 21 and 22 of the slide closure 20 is fastened on the tongue 13 of a respective flap 10 by means of a continuous band, respectively 23 and 24, supporting the corresponding half-parts 21 or 22.

In order to improve the leaktightness and to protect the slide closure 20, each tongue 13 of the flaps 10 is formed from two parallel lips **13*a* and 13*b* between which is fastened the band 23 or 24 supporting one of the two half-part 21 or 22 of the corresponding slide closure 20, the lip 13*a* of one of the tongues 13 straddling the lip 13*a* of the other tongue 13**.

Figure 8:
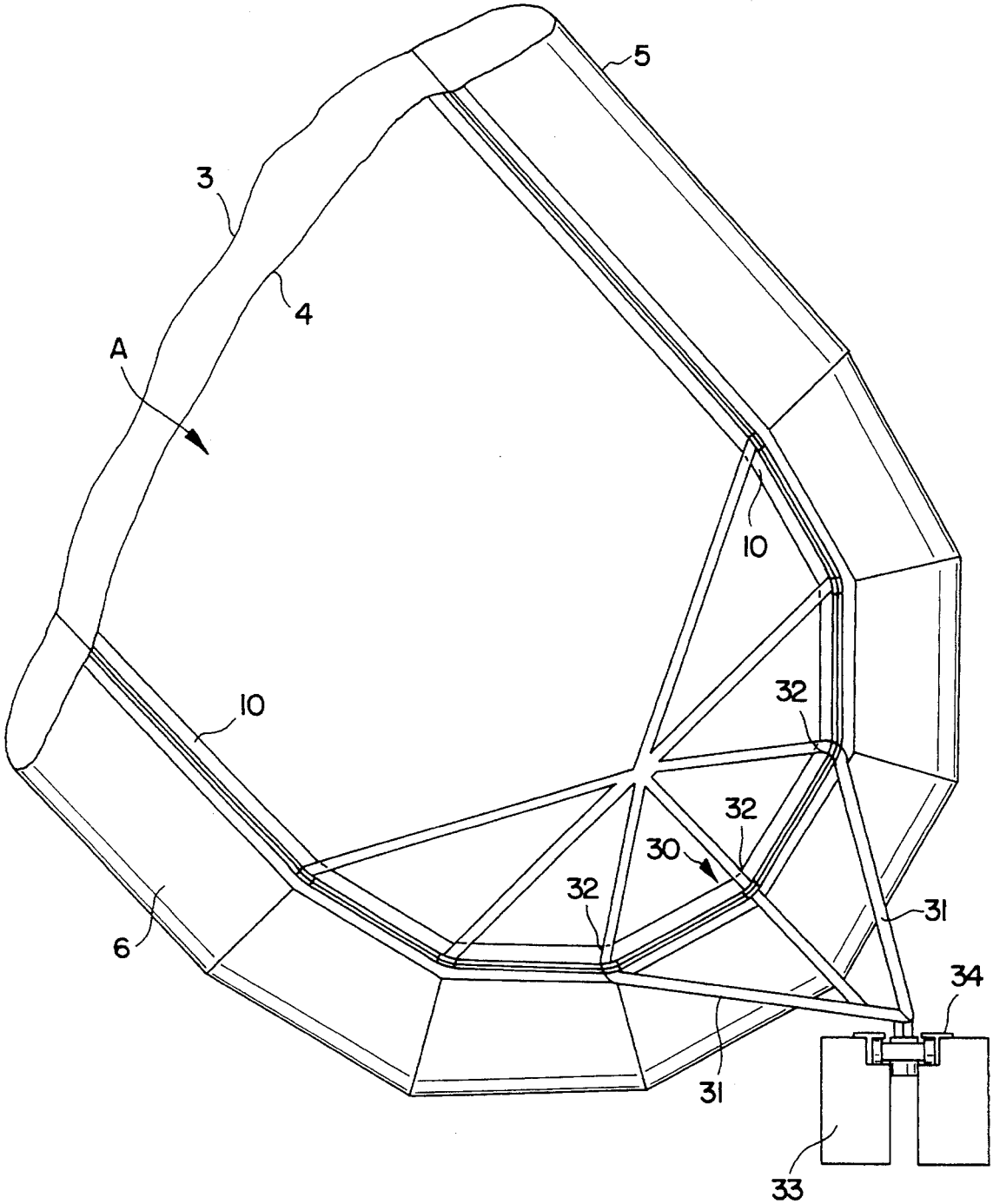
FIG. 8 is a diagrammatic view of one end of a beam of the vault according to the invention.

The flap 10 located on one and the same side of each beam A, B, C, . . . is continuous and forms a loop 30 at each end of such beam, as shown in FIG. 8.

Figure 9:
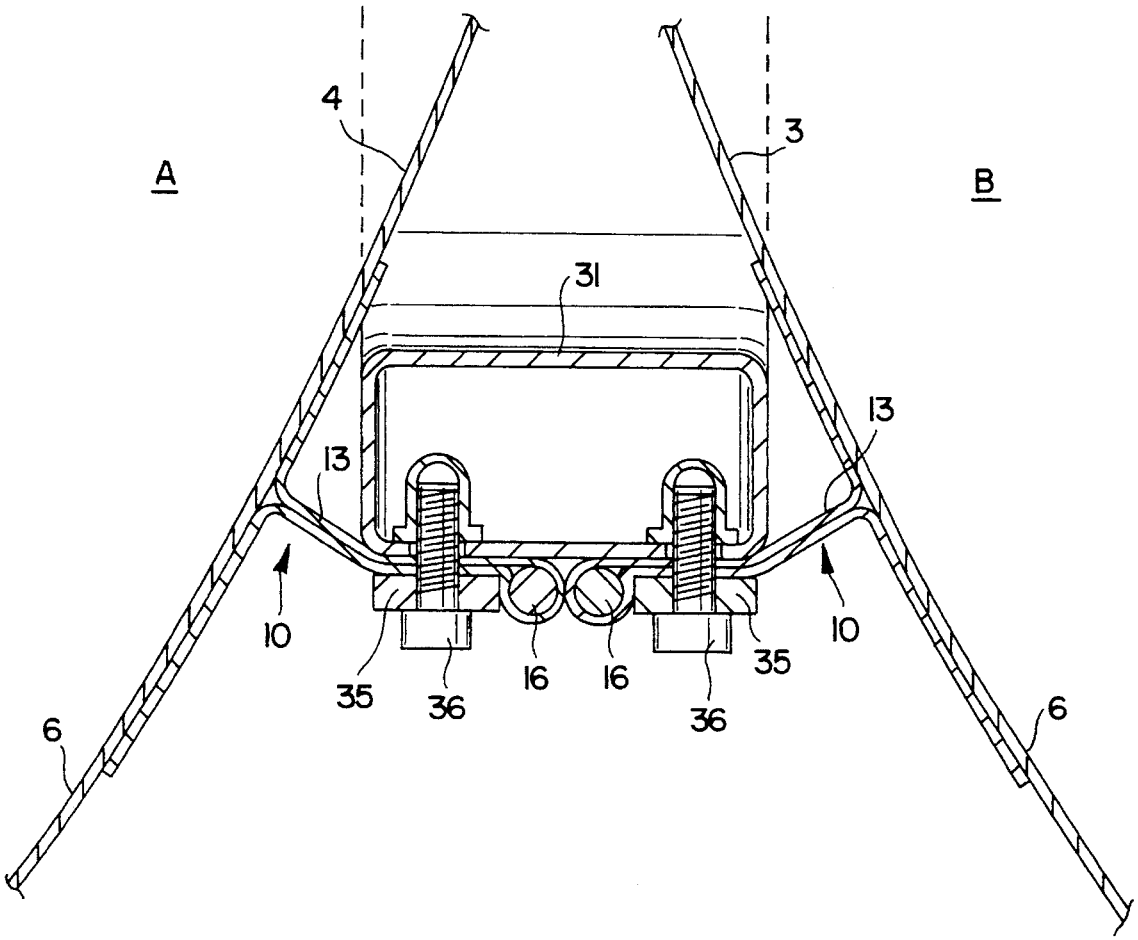
FIG. 9 is a view in section of means for fastening bearing fittings on two contiguous beams.

As shown in FIGS. 8 and 9, the vault I according to the present invention comprises movable bearing fittings 31, arranged between the ends of two contiguous beams, for example beams A and B, and connected by fastening means 32 to the flaps 10 of such two contiguous beams at the level of the end loops 30 of the flaps 10 thereof.

The fittings 31 interact with a fixed base 33 equipped with guide means 34, the profile of which determines a deployment and folding path of each of the beams A, B, C, . . . . The fastening means 32 of the fittings 31 with the contiguous tongues 13 of two flaps 10 are formed by two longitudinal small bars 35 each gripping, by means of bolts 36, a tongue 13 against the corresponding fitting 31. Each small bar 35 bears on the filler strip 16 of the tongue 13.

The advantages of the present invention result essentially from the possibility which it offers of producing vaults of very large dimensions, composed of a plurality of component elements which are easy to manufacture, easy to transport and to assemble with no special tooling, directly on site, and which may be erected or retracted very rapidly.

The inflatable vault according to the present invention applies to the production of a roof for stadia, swimming pools, tennis courts, sports halls, restaurants, theatres, exhibition halls or shops, diverse installations, leisure parks, conference halls or large-size storage sheds.

It is particularly adapted to the protection against bad weather of places frequented by the public and which it is desired, nevertheless, to uncover in fine weather, but it may also apply to permanently roofed installations.

I claim:

1. A multi-lobed, double-wall inflatable vault that can be deployed and retracted and that can confine between walls thereof a layer of air under pressure, said vault comprising:

a plurality of distinct, inflatable hollow beams;

each said beam being formed by a single continuous envelope ensuring continuity of leaktightness of a volume confined thereby, and each said beam having four zones including two lateral zones defining webs of said beam and upper and lower zones defining flanges of said beam;

said beams being arranged side by side contiguously;

respective confronting webs of two adjacent said beams being held opposite each other by respective continuous longitudinal flaps to be joined by mechanical linking structure; and each said flap having a T-shaped transverse cross-sectional configuration including two lateral flanges fastened to said envelope of the respective said beam and a central tongue to be linked by the linking structure to the tongue of said flap of said adjacent beam.

2. A vault as claimed in claim 1, further comprising said linking structure linking together said tongues.

3. A vault as claimed in claim 2, wherein said linking structure comprises eyelet holes spaced longitudinally of each of said tongues, and a continuous link successively threaded through aligned said eyelet holes of said tongues.

4. A vault as claimed in claim 3, further comprising continuous filler strips trapped along free edges of said tongues.

5. A vault as claimed in claim 3, wherein said continuous link comprises a cable.

6. A vault as claimed in claim 2, wherein said linking structure comprises a slide closure including two half-parts attachable to and detachable from each other by a slider, each said half-part being fastened to a respective said tongue.

7. A vault as claimed in claim 6, wherein each said tongue is formed by two parallel lips, and each said half-part is supported between said lips of the respective said tongue.

8. A vault as claimed in claim 1, wherein said flap comprises at least one folded strip of coated fabric.

9. A vault as claimed in claim 1, wherein said webs and said flanges of each said beam are formed by respective surfaces of said envelope thereof, adjacent said surfaces intersecting along intersections, and said flaps of said adjacent beams are fastened to the respective said envelopes along said intersections.

10. A vault as claimed in claim 1, wherein said webs and said flanges of each said beam are formed by surfaces of said envelope thereof that merge tangentially at tangent lines, and said flaps of said adjacent beams are fastened to the respective said envelopes along said tangent lines.

11. A vault as claimed in claim 1, wherein a side of each said beam has at opposite edges thereof respective said flaps that are continuous and joined to form a loop at each end of said beam.

12. A vault as claimed in claim 11, further comprising movable bearing fittings arranged between ends of two adjacent said beams and connected to said flaps thereof at said loops thereof by a fastening device, said fittings being movable along a guide on a fixed base and defining a path of deployment and retraction of said beams.

13. A vault as claimed in claim 12, wherein said fastening device comprises bolted small bars gripping said tongues of said flaps of said two adjacent beams.

14. A vault as claimed in claim 1, further comprising movable bearing fittings arranged between ends of two adjacent said beams and connected to said flaps thereof by a fastening device, said fittings being movable along a guide on a fixed base and defining a path of deployment and retraction of said beams.

15. A vault as claimed in claim 14, wherein said fastening device comprises bolted small bars gripping said tongues of said flaps of said two adjacent beams.

* * * * *